US006676866B2

(12) United States Patent
Harris et al.

(10) Patent No.: US 6,676,866 B2
(45) Date of Patent: Jan. 13, 2004

(54) GOLF BALL COMPOSITIONS INCLUDING MICROCELLULAR MATERIALS AND METHODS FOR MAKING SAME

(75) Inventors: Kevin M. Harris, New Bedford, MA (US); Murali Rajagopalan, South Dartmouth, MA (US); Christopher Cavallaro, Lakeville, MA (US)

(73) Assignee: Acushnet Company, Fairhaven, MA (US)

( * ) Notice: Subject to any disclaimer, the term of this patent is extended or adjusted under 35 U.S.C. 154(b) by 63 days.

(21) Appl. No.: 10/142,168

(22) Filed: May 10, 2002

(65) Prior Publication Data

US 2002/0193179 A1 Dec. 19, 2002

Related U.S. Application Data

(62) Division of application No. 09/565,108, filed on May 4, 2000, now Pat. No. 6,386,992.

(51) Int. Cl.[7] ..... B29C 43/18; B29C 44/06
(52) U.S. Cl. ..... 264/46.4; 264/50; 264/321
(58) Field of Search ..... 264/50, 321, 46.4

(56) References Cited

U.S. PATENT DOCUMENTS

| | | | | |
|---|---|---|---|---|
| 4,274,637 A | | 6/1981 | Molitor | 273/235 R |
| 4,431,193 A | | 2/1984 | Nesbitt | 273/235 R |
| 4,454,253 A | * | 6/1984 | Murphy et al. | 521/112 |
| 4,473,665 A | | 9/1984 | Martini-Vvedensky et al. | 521/79 |
| 5,160,674 A | | 11/1992 | Colton et al. | 264/50 |
| 5,181,717 A | | 1/1993 | Donntag et al. | 273/58 BA |
| 5,783,293 A | * | 7/1998 | Lammi | 428/212 |
| 5,824,746 A | | 10/1998 | Harris et al. | 525/196 |
| 5,849,237 A | * | 12/1998 | Inoue | 264/319 |
| 6,037,383 A | | 3/2000 | Krech et al. | 521/155 |
| 6,132,324 A | * | 10/2000 | Hebert et al. | 473/378 |
| 6,200,512 B1 | * | 3/2001 | Dewanjee et al. | 264/250 |

FOREIGN PATENT DOCUMENTS

| | | |
|---|---|---|
| WO | WO 97/06935 | 2/1997 |
| WO | WO 98/00450 | 1/1998 |
| WO | WO 98/08667 | 3/1998 |
| WO | WO 99/31521 | 7/1998 |
| WO | WO 99/32543 | 7/1999 |
| WO | WO 99/32544 | 7/1999 |
| WO | WO 99/63019 | 12/1999 |

OTHER PUBLICATIONS

"MuCull ® Microcellular Foam Process for Injection Molding," Trexel, Inc. Oct. 20, 1998.
"MuCell ® Molding Technology, MuCell ® Continuous Microcellular Foam Process for Injection Molding," Trexel, Inc., Oct. 2, 1998.
"Microcellular Molding," Trexel, Inc., Reprinted from *European Plastic News*—Sep. 1998.
"Trexel and Engel Canada Sign Agreement to Supply Injection Molding Equitpment Capable of Processing Microcellualr Foam," Press Release, Aug. 14, 1998.
"Trexel Unveils Commercialization of MuCell ® Microcellular Foam Process," Press Release, Jun. 18, 1998.
A. Behravesh, et al., "Approach to the Production of Low–Density, Microcellular Foams in Extrusion," *Antee '98*, vol. II, Conference Proceedings, Apr. 26$^{th}$–30$^{th}$, 1998, pp. 1958–67.

(List continued on next page.)

*Primary Examiner*—Allan R. Kuhns
(74) *Attorney, Agent, or Firm*—Swidler Berlin Shereff Friedman, LLP

(57) ABSTRACT

This invention is directed to golf balls including one or more foamed, microcellular materials. The invention also encompasses methods of controlling or adjusting one or more material properties or the weight distribution of a golf ball, and methods of forming golf balls including such microcellular materials.

16 Claims, 1 Drawing Sheet

OTHER PUBLICATIONS

C. Barlow, et al., "Solid–State Microcellular CPET Foams: The Effect of Nucleating Agents and Impact Modifiers," *Antee '98* vol. II, Conference Proceedings, Apr. $26^{th}$–$30^{th}$, 1998, pp. 1944–1948.

"Trexel's MuCell Technology Applied to Standard Melt Index Polypropylenes Process Presents New Foaming Opportunities for Plastics Manufacturers," Press Release, Apr. 16, 1998.

L. Matuana et al., "Characterization of Microcellular Foamed Plastics/Cellulosic Fiber Composites," Technical Papers of the Annual Technical Conference—Society of Plastics Engineers Incorporated, 1998; Conf. 56; vol. 2, pp. 1968–1975.

"Trexel Questions and Answers," 1998.

"Trexel's MuCell Polymer Foam Process Added to EPA Database of Approved Technologies," Press Release, Mar. 2, 1998.

S. Nadis, "Bubbles by the Billions," *Technology Review*, Jan./Feb., 1998, pp. 11–12.

* cited by examiner

GOLF BALL COMPOSITIONS INCLUDING MICROCELLULAR MATERIALS AND METHODS FOR MAKING SAME

CROSS-REFERENCE TO RELATED APPLICATIONS

This application is a divisional of U.S. patent application Ser. No. 09/565,108, filed May 4, 2000, now U.S. Pat. No. 6,386,992, the entire disclosure of which is incorporated by reference herein.

FIELD OF INVENTION

The present invention is directed to golf balls and golf ball-forming microcellular materials, and to methods for forming such golf balls and of controlling material properties and weight distribution of golf balls formed of such materials.

BACKGROUND OF THE INVENTION

Conventional golf balls can be divided into several general classes: (a) solid golf balls having one or more layers, and (b) wound golf balls. Solid golf balls include one piece balls, which are easy to construct and relatively inexpensive, but have poor playing characteristics and are thus generally limited for use as range balls. Two-piece balls are constructed with a generally solid core and a cover and are generally the most popular with recreational golfers because they are very durable and provide maximum distance. Balls having a two-piece construction are commonly formed of a polymeric core encased by a cover. Typically, the core is formed from polybutadiene that is chemically crosslinked with zinc diacrylate and/or other similar crosslinking agents. These balls are generally easy to manufacture, but are regarded as having limited playing characteristics. Solid golf balls also include multi-layer golf balls that are comprised of a solid core of one or more layers and/or a cover of one or more layers. These balls are regarded as having an extended range of playing characteristics.

Wound golf balls are generally preferred by many players due to their high spin and soft "feel" characteristics. Wound golf balls typically include a solid, hollow, or fluid-filled center, surrounded by a tensioned elastomeric material and a cover. Wound balls generally are more difficult and expensive to manufacture than solid two-piece balls.

Golf ball performance characteristics are typically described in terms of their distance, durability, spin and feel. These characteristics need not be mutually exclusive, and yet golf balls that have a suitable feel, such as those with balata covers, tend not to be extraordinarily durable. This is because materials that have high tensile and compressive strengths often diminish the compressibility of the balls into which they are incorporated, and thus they generally feel hard. There thus exists a need for resilient and durable materials that may be used to form golf ball covers, mantle layers, and centers that retain the soft feel desired by many golfers.

Numerous attempts have been made to provide such materials. For example, U.S. Pat. Nos. 4,274,637 and 4,431,193 disclose covers and mantle layers, respectively, made of cellular, or foamed ionomer materials. These materials, which are lighter than the solid materials from which they are made, are produced with blowing agents, nucleating agents, and other additives that thermally decompose at high temperatures to form bubbles within a polymer melt. Foamed materials made in this manner are hereinafter referred to as "conventional foams."

U.S. Pat. No. 5,824,746 discloses golf balls covers comprising foamed, metallocene-catalyzed polymers. These polymers were also formed using conventional blowing or foaming agents.

The use of foamed materials can alter the coefficient of restitution of a golf ball, which is generally indicative of its resiliency. Resiliency, which is regulated by the U.S. Golf Association, is measured by the "Initial Velocity Test," wherein a golf ball is struck by a club face moving at a speed of approximately 146 feet per second. Once struck by the club face, the velocity of the ball is measured. The maximum prescribed limit for a golf ball tested in this manner is 250+2% ft/s at 75° F.

Conventional foams typically include about $10^3$ to $10^6$ cells/cm$^3$, with the cells averaging about 100 $\mu$M or larger in diameter. It is this large average size and an uneven cell size distribution that are believed to account for the relatively poor mechanical properties of conventional foams. See, e.g., Behravesh, A. H., et al., *Antec '98 Conference Proceedings,* vol. II, pp. 1958–1967 (Apr. 26–30, 1998). Consequently, golf balls including conventional foams are expected to be inferior compared to those that do not include such conventional foams.

A further limitation of conventional foams is that they cannot be used to form materials thinner than the average cell size of about 100 $\mu$M. This limitation restricts the applications in which foamed materials may be used. In addition, the conventional foams require chemical blowing agents, which may produce some environmental concerns.

A material property of conventional foams can be modified or improved by the use of microcellular materials. These materials are made by exposing a polymer melt to a gas under high pressure, and then quickly removing that pressure. The resulting cells are smaller, more narrowly distributed with regard to size, and occur in higher densities than those of conventional foams. Until recently, however, microcellular materials were made primarily from simple, single component polymer melts, such as polystyrene.

For example, U.S. Pat. No. 4,473,665 discloses microcellular closed cell foams made from polystyrene, polycarbonate, polyester, nylon, or a thermoplastic material, and a method of making such foams. Also disclosed are closed cell sizes on the order of 2 to 25 microns, as well as the addition of fillers such as carbon black to control void size.

U.S. Pat. No. 5,160,674 discloses microcellular foams of amorphous or semi-crystalline polymers, such as polyethylene or polypropylene, having bubbles on the order of 5 to 25 microns in diameter with bubble density of approximately $10^{10}$ bubbles/cm$^3$.

Recently, reports have begun to surface in the literature of microcellular materials made from mixtures of polymeric and other compounds such as cellulose fiber. See, e.g., Barlow, C., et al., *Antec '98 Conference Proceedings* vol. II, pp. 1944–1948 (Apr. 26–30, 1998); and Matuana, L. M. et al., *Antec '98 Conference Proceedings* vol. II, pp. 1968–1975 (Apr. 26–30, 1998).

U.S. Pat. No. 5,181,717 discloses an inflated bladder-type sports or leisure ball, e.g., a football, that includes an external layer of polyurethane or polyurethane-polyurea foam with compact integral skin. The foamed layer is microalveolate or microcellular at its core, with a compact skin and an intermediate zone between the core and skin with progressively smaller cells towards the skin.

WO 99/63019 discloses microcellular thermoplastic elastomeric polymeric structures having an average cell size less than 100 $\mu$m in diameter. These materials may be formed from a thermoplastic elastomeric olefin, preferably metallocene-catalyzed polyethylene, with article densities ranging from less than 0.5 g/cm$^3$ to less than 0.3 gm/cm$^3$.

U.S. Pat. No. 6,037,383 discloses microcellular polyurethane elastomers having improved dynamic properties based on an isocyanate consisting essentially of 4,4'-MDI.

Despite these disclosures of microcellular materials, however, Applicants are not aware of any disclosures that include such microcellular materials in golf balls. Thus, the need still exists to produce components with material properties modified by the use of microcellular materials.

SUMMARY OF THE INVENTION

This invention is directed to microcellular golf ball-forming materials for one-piece, two-piece, and multi-layer (i.e., three or more layers) golf balls, such as golf balls that are fluid-filled, include one or more wound layers, include a multi-layer cover, and the like.

In particular, the invention encompasses a golf ball including at least one core layer and at least one cover layer disposed over the at least one core layer, with the at least one cover layer having a thickness of at least about 0.03 inches, wherein at least one of the core layers or cover layers is formed of a microcellular composition having an average cavity density of about $10^5$ cavities/cm$^3$ to $10^{14}$ cavities/cm$^3$, and an average cavity diameter of less than about 100 microns. In one embodiment, the cover has at least one of a dimple coverage of greater than about 60 percent, a hardness from about 35 to 80 Shore D, or a flexural modulus of greater than about 500 psi, and the golf ball has at least one of a compression from about 50 to 120 or a coefficient of restitution of greater than about 0.7.

The microcellular composition preferably has an average cavity diameter from about 0.1 microns to 95 microns, more preferably from about 5 microns to 50 microns. The microcellular composition can further include at least one of a stabilizer, crosslinking agent, pigment, brightener, lubricant, or density-adjusting filler. In particular, the microcellular composition preferably includes a polymer selected from the group of thermoplastics, thermoplastic elastomers, rubbers, thermosets, and mixtures thereof.

In one embodiment, the microcellular composition includes a polymer having a hardness of at least about 15 Shore A, a flexural modulus of at least about 500 psi, a density of at least about 0.3 g/cm$^3$, and a rebound of at least about 30%. In another embodiment, the polymer includes at least one of a copoly(ether-ester), copoly(ether-urethane), copoly(ester-urethane), copoly(ether-amide), or metallocene-catalyzed polymer.

As noted above, any type of golf ball construction may be formed according to the invention. In one embodiment, at least one of the core layers includes the microcellular composition. In another embodiment, the core layers include at least one center layer including a fluid and at least one intermediate layer including the microcellular composition disposed about the at least one center layer. In yet another embodiment, the golf ball has at least two core layers including a first core layer including a tensioned elastomeric material wound about a second core layer including the microcellular composition. The microcellular composition can be included to modify the density and/or moment of inertia of the golf ball or portions thereof. The moment of inertia of the golf ball should typically be from about 0.3 to 0.9 g/cm$^2$.

The invention also relates to a golf ball having an Atti compression of at least about 50 and a coefficient of restitution of at least about 0.7 at 125 ft/sec that includes a solid core having a deflection of about 1 mm to 6 mm under a load of 100 kg, and at least one cover layer disposed over the core and being formed of a microcellular composition having an average cavity density of about $10^5$ cavities/cm$^3$ to $10^{14}$ cavities/cm$^3$, and an average cavity diameter of less than about 100 microns.

The invention also encompasses a golf ball having an Atti compression of at least about 50 and a coefficient of restitution of at least about 0.7 at 125 ft/sec that includes a core, an inner cover layer disposed over the core and being formed of a microcellular composition having an average cavity density of about $10^5$ cavities/cm$^3$ to $10^{14}$ cavities/cm$^3$, and an average cavity diameter of less than about 100 microns, and an outer cover layer disposed over the inner cover layer and having a flexural modulus of about 10,000 psi to 70,000 psi.

Methods of forming such golf balls are also encompasses by the invention. In one embodiment, a method of adjusting at least one material property or weight distribution of a golf ball includes at least partially melting a polymeric material, saturating the melted polymeric material with a gas at a first pressure sufficient to substantially uniformly distribute the gas through the melted polymeric material, shaping the gas-saturated polymeric material at an elevated pressure to prevent substantial cell nucleation within the material, sufficiently reducing the first pressure, in the absence of sonic vibration, and supersaturating the shaped polymer material with a gas so that the polymer material is modified to form a substantially uniformly nucleated shaped microcellular polymeric material having closed-cell, microcellular voids having a diameter of no greater than about 100 microns, solidifying the microcellular polymer material sufficiently to inhibit formation of additional voids, and incorporating the microcellular polymeric material into a golf ball.

The polymeric material is preferably selected from the group of thermoplastics, thermoplastic elastomers, rubbers, thermosets, and mixtures thereof. In a preferred embodiment, the polymeric material is combined with at least one additive before being exposed to the gas. The at least one additive typically includes a stabilizer, crosslinking agent, pigment, brightener, lubricant, density-adjusting filler, or a combination thereof.

The method preferably uses a gas that includes air, a noble gas, nitrogen, carbon dioxide, or a mixture thereof. The gas flow rate is typically at least about 0.005 lbs./hr.

The incorporating into a golf ball can include forming the microcellular composition into portion of a golf ball core, and disposing a dimpled outer cover over the core so as to form the golf ball. In one embodiment, the forming includes forming the microcellular composition into a golf ball center, and providing at least one mantle layer over the center. In the alternative, the incorporating step can include forming a golf ball core, and forming a material including the microcellular composition into at least a portion of a golf ball cover. In another embodiment, the forming includes at least one of injection molding, compression molding, reaction injection molding, or casting the microcellular composition. In yet another alternative, the golf ball can be a one-piece golf ball formed of a material including the microcellular composition.

This invention is also directed to a method of affecting the weight distribution within a golf ball. In this embodiment, the moment of inertia may be adjusted by varying the type and density of the microcellular materials of the invention. For example, a golf ball can be prepared having a moment of inertia from about 0.3 g/cm$^2$ to 0.9 g/cm$^2$. In another embodiment, this invention encompasses a method of modifying the material properties of the golf ball components. This method includes the incorporation of a microcellular material into a golf ball as described herein.

BRIEF DESCRIPTION OF THE DRAWINGS

Further features and advantages of the invention can be ascertained from the following detailed description that is provided in connection with the drawings described below.

DEFINITIONS

Figure 1:
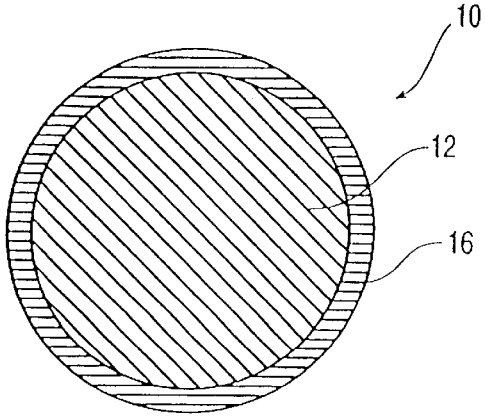
FIG. 1 illustrates a golf ball having a single core layer and a single cover layer according to the invention.

As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. When the Atti Gauge is used to measure cores having a diameter of less than 1.680 inches, it should be understood that a metallic or other suitable shim is used to make the measured object 1.680 inches in diameter.

As used herein, the terms "cell," "cavity," "void," and "bubble" each refer to a region within a material that is not filled by that material. The "cell" may contain another material or may be a void, but preferably the cell contains a gas, typically air.

As used herein, the term "diameter" when used to describe a cell refers to the average distance between opposing boundaries of that cell, and does not imply that the cell is spherical in shape.

As used herein, the term "microcellular material" means a material including cells having average diameters of less than 100 $\mu$m, and in particular to material including cells having average diameters from about 0.1 $\mu$m to 95 $\mu$m in diameter on average and a density from about $10^5$ cells/cm$^3$ to $10^{14}$ cells/cm$^3$, preferably from about $10^7$ cells/cm$^3$ to $10^{10}$ cells/cm$^3$.

As used herein, the terms "conventional foamed material" and "conventional foam" mean a cellular material that is not a microcellular material, e.g., has cells with an average diameter of greater than 100 $\mu$m. Examples of conventional foamed materials include those described in U.S. Pat. No. 4,274,637.

As used herein, the term "cover" means the outermost portion of a golf ball. A cover typically includes at least one layer and may contain indentations such as dimples and/or ridges. Paints and/or laminates are typically disposed about the cover to protect the golf ball during use thereof.

As used herein, the term "core" means the innermost portion of a golf ball, and may include one or more layers. When more than one layer is contemplated, the core includes a center and at least one mantle layer disposed thereabout. At least a portion of the core, typically the center, is solid or fluid. The core may also include one or more wound layers including at least one tensioned material wound about the center.

As used herein, the term "mantle layer" means a portion of a golf ball positioned between the center and cover of a golf ball. The mantle layer is also sometimes referred to as an inner cover layer or an intermediate layer in the golf ball art.

As used herein, the term "fluid" means a gas, liquid, gel, paste, or the like, or a combination thereof.

As used herein, the terms "polymer" and "polymeric material" include amorphous, semi-crystalline, or crystalline polymers, and mixtures thereof, including, for example, random and block copolymers, rubbers, thermoplastics, thermoplastic elastomers, and the like.

As used herein, the term "compatible blend" means a blend of two or more polymers that is heterogeneous on a microscopic scale, but homogeneous on a macroscopic scale, and has useful golf ball properties.

The term "about," as used herein in connection with one or more numbers or numerical ranges, should be understood to refer to all such numbers, including all numbers in a range.

DETAILED DESCRIPTION OF THE INVENTION

This invention is directed to golf balls and golf ball-forming compositions including one or more microcellular materials. The compositions of the present invention possess numerous advantages over conventional golf ball-forming compositions, including lower material costs, lighter weight, and potential improvements in materials properties. The compositions of this invention may be formed without the nucleating agents used to make conventional foamed materials, and possess smaller cavities of more narrowly distributed sizes than those of conventional foamed materials. Materials made from the compositions of this invention, and the resultant golf balls incorporating such materials, are expected to be more durable than materials made of conventional foams.

The materials of this invention may be made with nucleating agents, but are preferably made without such agents. As noted herein, the golf balls of the invention are formed from materials that include thermoplastic polymers, thermoset polymers such as polybutadiene, or mixtures of such polymers and/or copolymers. Further, these materials may include ingredients such as, but not limited to, stabilizers, crosslinking-agents, pigments, brighteners and other such additives, such as reinforced glass fibers, etc. The microcellular materials of this invention can be used to form materials thinner than conventional materials, since the cell sizes are no greater than 100 $\mu$m.

The microcellular material compositions of this invention may thus be used to form any part of a dual- or multi-layer golf ball, including its center, mantle layer(s) and cover. Preferably, the microcellular material compositions are used to form part of the core, i.e., the center or one of a plurality of optional mantle layers disposed between the center and cover. Consequently, this invention is further directed to golf balls including microcellular materials and methods of forming the same. The golf balls incorporating including a microcellular material may be one-piece, two-piece, or multi-layer golf balls, although the golf balls are preferably two-piece or multi-layer golf balls. The golf balls of this invention provide numerous advantages over conventional golf balls, which typically include lower material costs and modified material properties. It should be noted, however, that the present invention does contemplate golf balls including combinations of both microcellular and conventional foamed materials.

The compositions of the invention allow the golf ball manufacturer to adjust the density or mass distribution of the ball into which they are incorporated, thereby affecting resiliency, spin rate, and performance. When at least a portion of the golf ball core or center is formed from a microcellular material, a density-adjusting filler material can be added to, e.g., the cover or the mantle, to distribute the mass of the ball towards the outer surface to adjust the angular moment of inertia of the golf ball. Similarly, when a microcellular material is used to form at least a portion of the cover, a density-adjusting filler material can be added to part of the core to decrease the angular moment of inertia of the ball. Alternatively, when a microcellular material is used to form at least a portion of a mantle layer, a density-adjusting filler material can be added to either the cover or the center, or both. This invention is thus further directed to a method of adjusting the weight distribution within a golf ball by incorporating one or more microcellular materials into a desired portion of a golf ball.

The compositions of this invention may be made according to the methods disclosed by U.S. Pat. Nos. 4,473,665 and 5,160,674, both of which are incorporated herein in their entirety by express reference thereto. Other methods of producing microcellular materials are well known to those of ordinary skill in the art, and include commercial processing means such as the nucleation device disclosed by WO 97/06935, as well as the processes described by PCT Publications WO 99/32543; WO 99/32544; WO 98/31521; and WO 98/08667. Moreover, U.S. Pat. No. 6,037,383, for example, discloses microcellular polyurethane elastomers and other materials suitable for use in the present invention to form golf balls incorporating microcellular compositions.

During the microcellular material forming process, the gas flow rate is typically at least about 0.005 lbs./hr. In one embodiment, the gas flow rate is from about 0.02 to 0.2 lbs./hr. A mold temperature of at least about 30° F. is typically used. The microcellular process generally occurs as follows:

1. A supercritical fluid (SCF) of an atmospheric gas is injected into the polymer through a barrel to form a single-phase solution, with the SCF delivery system, screw, and injectors designed to allow for rapid dissolution;

2. A large number of nucleation sites, which are present in orders of magnitude greater than conventional foaming processes, are formed where controlled cell growth occurs by using a large and rapid pressure drop to help create uniformity in this process;

3. Cells are expanded by diffusion of gas into the bubbles; and

4. Mold design is used to control the shape of the part as desired.

For example, a semi-crystalline polymer material is typically selected and heated above the melting point thereof; the melted polymer material is saturated with a substantially uniformly or uniform concentration of gas; the gas-saturated polymer material is shaped in a cavity, mold, or die at an elevated pressure to substantially prevent cell nucleation within the material; uniform or substantially uniform bubble formation in the polymer is initiated in the absence of sonic vibrations by reducing the pressure and supersaturating the polymer with gas resulting in a uniform or substantially uniform nucleated shaped polymer material having closed-cell, microcellular voids having an average diameter of no greater than 100 microns; and the temperature of the polymer material is lowered below the melting point of the material to inhibit or prevent further cell growth.

The compositions of this invention include any polymer or mixture of polymers suitable for incorporation into a golf ball. The particular polymer or mixture of polymers will depend upon the proposed use of the composition, i.e., durable and rigid polymers will typically be chosen when the composition is used to form covers, while softer polymers and rubbers will typically be used in compositions used to form one or more optional mantle layers and/or the center. Consequently, suitable polymers for use in forming microcellular materials for incorporation into a golf ball may be readily selected by one of ordinary skill in the art, and include the following exemplary polymers: homo and copolymers of polystyrene, polyethylene, polypropylene, polyester, thermoplastic or thermoset polyurethane, polyamide, polycarbonate, urea, epoxy, poly(ethylethylene), poly(heptylethylene), poly(hexyldecylethylene), poly (isopentylethylene), poly(butyl acrylate), poly(2-ethylbutyl acrylate), poly(heptyl acrylate), poly(2-methylbutyl acrylate), poly(3-methylbutyl acrylate), poly(N-octadecylacrylamide), poly(octadecyl methacrylate), poly (butoxyethylene), poly(methoxyethylene), poly (pentyloxyethylene), poly(1,1-dichloroethylene), poly (cyclopentylacetoxyethylene), poly(4-[(2-butoxyethoxy) methyl]styrene), poly(4-dodecylstyrene), poly(4-tetradecylstyrene), poly(phenethylmethylethylene), poly [oxy(allyloxymethyl)ethylene], poly[oxy(ethoxymethyl) ethylene], poly(oxyethylethylene), poly (oxytetramethylene), poly(oxytrimethylene), poly (oxycarbonylpentamethylene), poly(oxycarbonyl-3-methylpentamethylene), poly(oxycarbonyl-1,5-dimethylpentamethylene), poly(silanes) and poly(silazanes), and main-chain heterocyclic polymers, as well as the classes of polymers to which they belong. The microcellular material may also be formed from a combination of one or more of these or other suitable polymers disclosed herein.

This invention also contemplates the use of metallocene-catalyzed polymers and polymer blends, such as those disclosed by U.S. Pat. No. 5,824,746, which is incorporated herein by express reference thereto. Consequently, compositions of the present invention may include compatible blends of at least one metallocene-catalyzed polymer and at least one ionomer that are formed using any blending method available to those of ordinary skill in the art. Typical metallocene-catalyzed polymer blends include compatible blends of metallocene polymers and ionomers, such as ethylene methacrylic acid ionomers, ethylene acrylic acid ionomers, and their terpolymers, sold commercially under the trade names SURLYN® and IOTEK® by E.I. DuPont deNemours of Wilmington, Del., and Exxon Corporation of Irving, Tex., respectively.

The polymer component of the compositions of this invention may also include any thermoplastic or thermoplastic elastomer (TPE) or thermoset. Exemplary TPEs suitable for use in the present invention include block copoly(ether- or ester-esters), block copoly(ether- or ester-amides), copoly(ether- or ester-urethanes), polystyrene TPEs, and mixtures, isomers and derivatives thereof.

Suitable commercially available copoly(ester-ether) TPEs include the HYTREL® series from DuPont, which includes HYTREL® 3078, G3548W, 4056, G4069W and 6356; the LOMOD® series from General Electric Company of Pittsfield, Mass., which includes LOMOD® ST3090A and TE3055A; ARNITEL® and URAFIL® from Akzo of Saint Louis, Ill.; ECDEL® from Eastman Kodak of Rochester, N.Y.; and RITEFLEX® from Hoechst Celanese of Corpus Christi, Tex. In a preferred embodiment, the thermoplastic elastomer includes HYTREL® 3078.

Suitable block copoly(ether-amide) TPEs are described by U.S. Pat. No. 4,331,786, which is hereby incorporated herein in its entirety by express reference thereto. Suitable commercially available thermoplastic copoly(amide-ethers) include the PEBAX® series from Elf-Atochem of Philadelphia, Pa., which includes PEBAX® 2533, 3533, 4033 and 6333; the GRILAMID® series by Emser Industries of Sumpter, S.C., which includes ELY 60; and VESTAMID® and VESTENAMER® by Creanova Inc. of Piscataway, N.J. (formerly known as Hüls America Inc.).

Suitable block copoly(ether-urethane) TPEs include alternating blocks of a polyurethane oligomer. The polyurethane block may include a diisocyanate, typically 4,4'-diphenylmethane diisocyanate, 4,4'-dicyclohexylmethane diisocyanate, 2,4-toluene diisocyanate, 2,6-toluene diisocyanate, para-phenylene diisocyanate or mixtures thereof, chains extended with a diol such as 1,4-butanediol, a dithiol such as 1,4-butanedithiol, a thio-substituted alcohol, such as 1-thiolbutane-4-ol, or mixtures thereof. Optionally, the block copoly(urethane) copolymer can be at least partially included of at least one dithioisocyanate.

Suitable block copoly(ester-urethane) TPEs include the ESTANE® series, which includes ESTANE® 58133, 58134, 58144 and 58311 and suitable block copoly(ether-urethane) TPEs include ESTANE® 58810, 58881, 5740X955, 5740X820, 5740X946, all of which are commercially available from the B.F. Goodrich Company; the PELLETHANE® series commercially available from Dow Chemical of Midland, Mich., which includes PELLETHANE® 2102–90A and 2103–70A; ELASTOLLAN® commercially available from BASF of Budd Lake, N.J.; DESMOPAN® and TEXIN® commercially available from Bayer of Pittsburgh, Pa.; Q-THANE® commercially available from Morton International of Chicago, Ill.; and PANDEX from Dannippon of Japan.

Block polystyrene TPEs suitable for use in this invention include blocks of polystyrene or substituted polystyrene, e.g., poly(α-methyl styrene) or poly(4-methyl styrene) chemically linked or joined to the ends of lower softening point blocks of either an unsaturated or saturated rubber. Unsaturated rubber types typically include butadiene, which can form styrene-butadiene-styrene (hereafter "SBS") block copolymers, or isoprene, which can form styrene-isoprene-styrene (hereafter "SIS") block copolymers, silicone rubber, balata, styrene-butadiene rubber ("SBR"), and the like. Examples of suitable commercially available thermoplastic SBS or SIS copolymers include the KRATON® D series from Shell Corporation of Houston, Tex., which includes KRATON® D2109, D5119 and D5298; VECTOR® from Dexco of Plaquemine, La.; and FINAPRENE® from Fina Oil and Chemical of Plano, Tex.

Suitable microcellular materials are typically those having a hardness of at least about 15 Shore A, a flexural modulus of at least about 500 psi, a density of at least about 0.3 g/cm$^3$, and a rebound of at least about 30%.

In addition to the polymer component, the compositions of this invention preferably include one or more additives or other ingredients. Particularly contemplated are those frequently found in golf ball compositions, including crosslinking agents, free-radical initiators, lubricants, pigments, brighteners, density-adjusting fillers, and the like, or combinations thereof, in amounts and ratios either known or readily determined by those of ordinary skill in the art. If a nucleating agent is used to form the final composition of the invention, it preferably should not react with any of these ingredients in a way that weakens or decomposes the final composition to such a degree that renders it unsuitable for incorporation into a golf ball.

Suitable crosslinking agents include, for example, metal salt diacrylates, dimethacrylates, and monomethacrylates wherein the metal is magnesium, calcium, zinc, aluminum, sodium, lithium or nickel. Preferably, the crosslinking agent is zinc diacrylate, more preferably zinc diacrylate containing less than about 10% zinc stearate.

Although not required, a free-radical source, often alternatively referred to as a free-radical initiator, may be included in the compositions of this invention. The free-radical initiator component is preferably included when the microcellular material will be incorporated into a golf ball center or mantle layer. The free-radical initiator may be any compound, or combination of compounds, present in an amount sufficient to initiate a crosslinking reaction to facilitate crosslinking of the polymer component of the composition. The free-radical initiator is preferably a peroxide, and more preferably an organic peroxide. Suitable free-radical initiators include, for example, di(2-t-butylperoxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate on calcium silicate, lauryl peroxide, benzoyl peroxide, t-butyl hydroperoxide, and mixtures thereof. In a preferred embodiment, the free radical initiator is an inhibitor-containing peroxide, such as 2,6-di-t-butylbenzoquinone, 2,6-di-t-butyl-4-methylene-2,5-cyclohexadiene-1-one, 2,6-di-t-butyl-4-hydroxybenzaldehyde, 2,6-di-t-butyl-4-isopropylphenol, 4,4'-methylene bis-(2,6-di-t-butylphenol), 1,2-bis-(3,5-di-t-butyl-4-hydroxyphenyl)ethane, 2,3,5,6-tetramethylbenzoquinone, 2-t-butylhydroquinone, 2,2'-methylene bis-(4-methyl-6-t-butylphenol), and the like, and mixtures thereof. The free-radical initiator is typically present in an amount greater than about 0.1 parts per hundred of the polymer component, preferably about 0.1 to 15 parts per hundred of the polymer component, and more preferably about 0.2 to 5 parts per hundred of the total polymer component. The free-radical source may alternatively or additionally be one or more of an electron beam, UV or gamma radiation, x-rays, or any other high energy radiation source capable of generating free radicals. It should be further understood that heat often facilitates initiation of the generation of free radicals when peroxides are used as a free-radical initiator.

The golf ball compositions of this invention may also include density-adjusting fillers such as zinc oxide, barium sulfate, metallic powders, and regrind (such as recycled core molding matrix ground to about 30 mesh particle size). Density-adjusting fillers are typically added to conventional golf ball core compositions to adjust the density and/or specific gravity of the core or portions thereof, and may be similarly included in the golf balls of the present invention.

The use of density-adjusting fillers in the present invention is optional, however, because the characteristics of the microcellular material prepared according to the invention can preferably used in this invention to adjust the density of a material or the moment of inertia of the ball as a whole, for example, modifying the cellular density and cell size of the microcellular material to adjust the moment of inertia. The moment of inertia of a golf ball is calculated as the sum of the products formed by multiplying the mass (or sometimes the area) of each element of a figure by the square of its distance from a specified line, such as the center of each component of a golf ball. This property is directly related to the radius of gyration of a golf ball, which is the square root of the ratio of the moment of inertia of a golf ball about a given axis to its mass. It has been found that the greater the moment of inertia, or the farther the radius of gyration is to the center of the ball, the lower the spin rate of the ball. By varying the weight, size, and density of the components of the golf ball, the moment of inertia can be modified to adjust the ball characteristics, such as the spin rate. For example, the ball can be prepared using the microcellular materials of the invention, optionally with density-adjusting fillers, to provide a moment of inertia that is typically from about 0.3 $g/cm^2$ to 0.9 $g/cm^2$. In one embodiment, the moment of inertia of the golf ball can be from about 0.35 $g/cm^2$ to 0.55 $g/cm^2$, while in one preferred embodiment, it can be from about 0.4 $g/cm^2$ to 0.5 $g/cm^2$. Thus, the golf ball typically has a specific gravity in the core from about 0.7 to 15, preferably from about 0.8 to 5, more preferably from about 0.9 to 2. When the core has a center and at least one intermediate layer, the intermediate layer typically has a specific gravity from about 0.7 to 12, preferably from about 0.8 to 5, more preferably from about 0.9 to 2. In one embodiment, the mantle as whole has a specific gravity no greater than 1.2, while in another the specific gravity is no less than 1.2.

The compositions of this invention may also include antioxidants that prevent elastomer breakdown. Useful antioxidants include quinoline type antioxidants, amine type antioxidants, and phenolic type antioxidants and the like, and mixtures thereof. Suitable types and amounts of antioxidant may be readily selected by one of ordinary skill in the art.

Other ingredients, such as accelerators, e.g., tetramethylthiuram, processing aids, processing oils, plasticizers, dyes, and pigments, may also be used in the methods and compositions of the present invention. Metals such as titanium, copper, and tungsten may also be added. Suitable amounts of such ingredients may be readily determined by one of ordinary skill in the art without undue experimentation.

It is preferred that each composition of this invention be made by mixing and combining its ingredients over a period of time and at a temperature suitable to produce a mixture of desired consistency and homogeneity. At this point, the mixture is exposed to a gas at a pressure and for a time sufficient for the gas to permeate the mixture. The pressure is then rapidly decreased in a manner sufficient to form cavities within the mixture that have an average diameter preferably from about 2 $\mu$m to 95 $\mu$m, more preferably from about 4 $\mu$m to 70 $\mu$m, and most preferably from about 5 $\mu$m to 50 $\mu$m. Suitable gases are preferably inert, and include, for example, air, one or more noble gases, nitrogen and carbon dioxide. Suitable pressures and times for such processes may be readily determined by those of ordinary skill in the art, particularly with reference to the literature and U.S. Pat. Nos. 4,473,665 and 5,160,674. The type of gas, gas pressure, length of pressurization, temperature, and the polymer component itself may all be varied to obtain microcellular materials with a variety of different densities, hardnesses, and resiliencies suitable for incorporation into golf balls.

As those of skill in the art are well aware, these and other variables depend, for example, upon the polymer or mixture of polymers within a given composition. To be specific, polymers with lower melting points are preferably foamed at lower temperatures so that decomposition does not occur. Temperature, time and pressure may also depend upon the chemical stability and reactivities of any crosslinking agents, free-radical initiators, antioxidants, or other optional ingredients that may be incorporated within the composition.

In another embodiment, a polymer, optionally combined with other ingredients, is converted into a microcellular material under conditions such as those described above, after which it is combined with additional ingredients. This method is particularly appropriate for the formation of microcellular compositions using nucleating agents that may react unfavorably with other reactive ingredients that are included in the polymer component, such as antioxidants.

Microcellular compositions can be readily incorporated into a golf ball, or a portion thereof, by any suitable golf ball forming method available to those of ordinary skill in the art. For example, while any portion of a golf ball may be made from the microcellular compositions disclosed herein, solid spherical centers may also be prepared from conventional compositions by any available method, such as compression molding, injection molding, reaction injection molding, co-injection molding, or casting techniques, preferably in a concentric fashion to maintain a substantially spherical center conventional method, such as compression or injection molding. A fluid-filled center may alternatively be formed instead of a solid center. Any additionally desired center layers may then be added to the center by conventional compression or injection molding techniques, including reaction injection, co-injection, or casting techniques, preferably in a concentric fashion to maintain a substantially spherical center. The mantle layer(s) may also be applied by any suitable method available to those of ordinary skill in the art.

The intermediate layer, or mantle layer, may be formed of any material available to those of ordinary skill in the art, such as a thermoplastic thread material. When thread is included in an intermediate layer, it preferably includes an elastomeric, polymeric material. Exemplary polymers include polyisoprene, polyether urea, such as LYCRA, polyester urea, polyester block copolymers such as HYTREL, isotactic-poly(propylene), polyethylene, polyamide, poly (oxymethylene), polyketone, poly(ethylene terephthalate) such as DACRON, poly(acrylonitrile) such as ORLON, and trans-diaminodicyclohexylmethane and dodecanedicarboxylic acid. LYCRA, HYTREL, DACRON, KEVLAR, and ORLON are available from E.I. DuPont de Nemours & Co. of Wilmington, Del.

Any conventional material or method may also be used in preparing the golf ball cover, which is typically disposed over the center or core. For example, as is well known in the art, ionomers, balata, and urethanes are all suitable golf ball cover materials. A variety of less conventional materials may also be used for the cover, e.g., thermoplastics such as ethylene- or propylene-based homopolymers and copolymers. These homopolymers and copolymers may also include functional monomers such as acrylic and methacrylic acid, fully or partially neutralized ionomers and their blends, methyl acrylate, methyl methacrylate homopolymers and copolymers, imidized amino group-containing polymers, polycarbonate, reinforced polycarbonate, reinforced polyamides, polyphenylene oxide, high impact polystyrene, polyether ketone, polysulfone, poly(phenylene sulfide), acrylonitrile-butadiene, acrylic-styrene-terephthalate, poly(ethylene terephthalate), poly(butylene terephthalate), poly(ethylene-vinyl alcohol), poly (tetrafluoroethylene), and the like. Any of these polymers or copolymers may be further reinforced by blending with a wide range of density-adjusting fillers, including glass fibers or spheres, or metallic powders. The selection of a suitable cover, and application thereof over the mantle described herein, will be readily determinable by those of ordinary skill in the art, particularly in view of the disclosure herein.

When golf balls are prepared according to the invention, they typically will have dimple coverage greater than about 60 percent, preferably greater than about 65 percent, and more preferably greater than about 70 percent. As measured by ASTM method D-790, the flexural modulus of the cover material for use on the golf balls is typically greater than about 500 psi, and is preferably from about 500 psi to 150,000 psi. The hardness of the cover material is typically from about 35 to 80 Shore D, preferably from about 40 to 78 Shore D, and more preferably from about 45 to 75 Shore D.

The resultant golf balls typically have a coefficient of restitution of greater than about 0.7, preferably greater than about 0.75, and more preferably greater than about 0.78. The golf balls also typically have an Atti compression of at least about 40, preferably from about 50 to 120, and more preferably from about 60 to 100. Additionally, any unvulcanized rubber, such as polybutadiene, used in golf balls prepared according to the invention typically has a Mooney viscosity greater than about 20, preferably greater than about 30, and more preferably greater than about 40. Mooney viscosity is typically measured according to ASTM D-1646.

Figure 2:
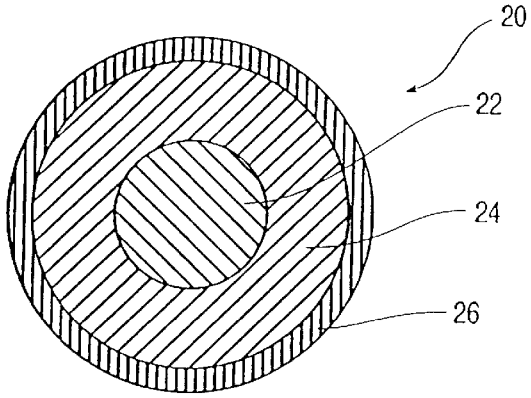
FIG. 2 illustrates a golf ball having three layers according to the invention.
Figure 3:
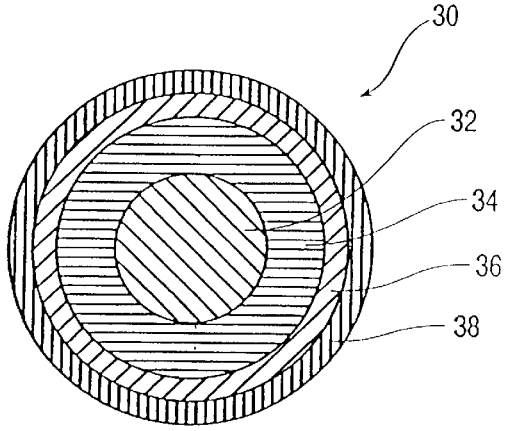
FIG. 3 illustrates a multi-layer golf ball according to the invention.

Referring to FIG. 1, a golf ball 10 of the present invention can include a core layer 12 and a cover layer 16 surrounding the core layer 12. In this embodiment, the core layer or the cover layer, or both, is formed from a material that includes the microcellular composition of the invention. Referring to FIG. 2, a golf ball 20 of the present invention can include two core layers 22 and 24, and a cover layer 26. In an alternative embodiment that depends on the thicknesses and materials used in each layer as will be readily understood by those of ordinary skill in the art, FIG. 2 depicts a single core layer 22, inner cover layer 24, and an outer cover layer 26. In either embodiment, a material including a microcellular composition of the invention is incorporated into one or more of the layers in FIG. 2. Referring to FIG. 3, a golf ball 30 of the present invention can include a plurality of core or cover layers. For example, the core layer 32 can be fluid-filled, in which case core layer 34 is a shell, optionally foamed, to contain the fluid therein. In one embodiment with the fluid-filled center, core layer 36 includes a tensioned elastomeric material and a cover layer 38 is disposed about the core layer 36. In another embodiment with a fluid-filled core layer 32, layer 36 is an inner cover layer and layer 38 is an outer cover layer. In yet another embodiment with a fluid-filled core layer 32, core layer 36 is a solid or foamed material and a cover layer 38 is disposed thereon. Alternatively, the innermost core layer 32 can be solid, one of core layers 34 and 36 includes a tensioned elastomeric material, and cover layer 38 is disposed thereabout. Although FIG. 3 shows only layers between the innermost core layer and the outermost cover layer, it will be appreciated that any number or type of intermediate core layers may be used, as desired. In FIG. 3, the microcellular composition of the invention could be included in any of the depicted layers, or in any combination of such layers.

EXAMPLES

The following examples are only representative of the methods and materials for use in golf ball compositions and golf balls of this invention, and are not to be construed as limiting the scope of the invention in any way.

Examples 1–16

Comparative Microcellular Material Characteristics

Fifteen sample materials were prepared for use according to the invention and one corresponding conventional material was prepared for comparison as noted below.

Microcellular materials were prepared by forming solid and foamed plaques of approximately 0.06 inches thickness of 57 weight percent polyetherester (HYTREL 3078), 20 weight percent of an n-butyl acrylate and ethylene methacrylic acid copolymer (NUCREL 960), and 23 weight percent zinc oxide. The injection molded foamed parts were made under 100 tons of clamp pressure with cycle times from approximately 13 to 28 seconds. The nitrogen gas flow rate was approximately 0.02 to 0.08 lbs./hr., with the best results generally occurring with a flow rate of 0.04 to 0.06 lbs./hr. These flow rates typically resulted in microcellular materials having a content of approximately 0.11 percent to 0.2 percent nitrogen by weight.

Flexural Modulus

A 1 in.×2 in. sample was cut from each of five plaques. The width and thickness of each sample were measured in triplicate and averaged and the flexural modulus was measured according to ASTM D-790, Test Method 1, although the samples were measured as received rather than being conditioned. The average flexural modulus and standard deviations are reported in the table below.

Tensile Properties

Samples as received were die-cut and tested for tensile properties according to ASTM D638–97.

Density

Approximately 2 grams of each sample was weighed in air using an analytical balance according to ASTM D297. The samples were also weight suspended on a thin wire in reagent alcohol with a previously determined density, and the density was then calculated.

Shore Hardness

A 1 in.×2 in. sample was cut from each of five plaques. The hardness was measured using Shore A and D durometers using ASTM D2240.

The flexural modulus, tensile properties, density, and hardness values, as described above, are reported in Table I:

TABLE I

MATERIAL PROPERTIES OF MICROCELLULAR COMPOSITIONS

| New Ex. # | Density (g/cm$^3$) | Density Reduction (%) | Melt Temp (F.) | Mold Temp (F.) | Flow Avg. Cell Size (microns) | Transverse Avg. Cell Size (microns) | Shore A Hardness | Shore D Hardness | Flex Mod. (KSI) | Tensile Modulus KSI | Tensile Strength, KSI | Tensile Yield Stress, KSI | Tensile Strain @ Break, % |
|---|---|---|---|---|---|---|---|---|---|---|---|---|---|
| 1 | 1.109 | 12.7 | 455 to 490 | 80 | 50 | 60 | 90.5 (0.5) | 34.3 (0.6) | 21.05 (0.32) | 8.65 (1.15) | 0.99 (0.04) | 0.85 (0.04) | 117.24 (9.37) |
| 2 | 0.971 | 23.6 | 460 to 490 | 65 | 50 | 70 | 81.2 (0.5) | 25.4 (0.5) | 10.06 (0.20) | 9.17 (1.90) | 1.15 (0.10) | 1.04 (0.13) | 135.40 (33.35) |

TABLE I-continued

MATERIAL PROPERTIES OF MICROCELLULAR COMPOSITIONS

| New Ex. # | Density (g/cm$^3$) | Density Reduction (%) | Melt Temp (F.) | Mold Temp (F.) | Flow Avg. Cell Size (microns) | Transverse Avg. Cell Size (microns) | Shore A Hardness | Shore D Hardness | Flex Mod. (KSI) | Tensile Modulus KSI | Tensile Strength, KSI | Tensile Yield Stress, KSI | Tensile Strain @ Break, % |
|---|---|---|---|---|---|---|---|---|---|---|---|---|---|
| 3 | 0.929 | 26.9 | 440 to 455 | 90 | 50 | 100 | 76.9 (1.1) | 23.8 (0.80) | 9.34 (0.43) | 7.28 (0.15) | 1.25 (0.02) | 1.07 (0.04) | 212.69 (16.43) |
| 4 | 1.166 | 8.3 | 440 to 455 | 50 | 70 | 90 | 90.1 (0.4) | 32.4 (1.1) | 20.20 (0.66) | 11.78 (0.52) | 1.43 (0.04) | 1.10 (0.03) | 159.12 (13.90) |
| 5 | 1.170 | 7.9 | 450 to 460 | 50 | 30 | 40 | 89.5 (0.6) | 34.3 (0.6) | 16.55 (4.13) | 8.38 (1.84)* | 1.28 (0.28)* | 1.10 (0.26)* | 153.02 (39.75)* |
| 6 | 1.138 | 10.5 | 435 to 445 | 50 | 30 | 60 | 90.8 (0.2) | 34.8 (0.3) | 22.18 (0.36) | 12.32 (1.05) | 1.84 (0.04) | 1.62 (0.06) | 109.00 (17.11) |
| 7 | 0.984 | 22.6 | 435 to 445 | 50 | 30 | 100 | 79.3 (0.6) | 24.5 (0.7) | 10.09 (0.30) | 7.68 (0.57) | 1.32 (0.04) | 1.04 (0.05) | 223.91 (20.75) |
| 8 | 0.999 | 21.4 | 435 to 445 | 50 | 50 | 60 | 87.6 (0.8) | 30.2 (0.7) | 16.48 (2.46) | 8.74 (1.36)* | 1.35 (0.08)* | 1.10 (0.07)* | 222.42 (76.66)* |
| 9 | 0.930 | 26.8 | 425 to 435 | 50 | 50 | 100 | 84.1 (3.5) | 29.4 (2.1) | 14.79 (3.88) | 7.61 (1.99) | 1.14 (0.28) | 0.95 (0.26) | 173.58 (51.76) |
| 10 | 0.816 | 35.8 | 445 to 480 | 120 | 50 | 60 | 73.5 (3.5) | 22.4 (1.6) | 11.26 (4.51) | 8.98 (1.71)* | 1.14 (0.02)* | 0.87 (0.09)* | 86.04 (46.27)* |
| 11 | 1.114 | 12.4 | 425 to 450 | 50 | 50 | 100 | 82.2 (2.3) | 26.7 (1.0) | 10.68 (1.49) | 8.11 (0.47) | 1.67 (0.06) | 1.14 (0.04) | 380.82 (18.25) |
| 12 | 1.015 | 20.1 | 425 to 450 | 50 | 40 | 100 | 86.9 (1.3) | 31.1 (0.5) | 12.61 (0.41) | 7.61 (0.72) | 1.44 (0.12) | 1.04 (0.06) | 323.99 (48.41) |
| 13 | 1.037 | 18.4 | 425 to 450 | 50 | 15 | 60 | 82.5 (1.1) | 27.0 (0.5) | 11.08 (0.32) | 6.70 (0.14) | 1.50 (0.01) | 1.13 (0.05) | 380.43 (10.18) |
| 14 | 1.011 | 20.5 | 445 to 480 | 50 | 50 | 100 | 86.3 (0.4) | 30.5 (0.3) | 13.23 (0.14) | 5.93 (0.51) | 0.98 (0.01) | 0.78 (0.02) | 178.03 (7.24) |
| 15 | 0.98 | 22.6 | 490 to 500 | 130 | 20 | 20 | 84.2 (0.9) | 26.0 (1.4) | 10.79 (1.44) | 5.42 (1.25) | 0.52 (0.13) | 0.51 (0.13) | 76.79 (17.79) |
| 16** | 1.271 | 0 | | | N/A | N/A | 92.3 (0.3) | 38.7 (0.5) | 18.24 (2.09) | 10.09 (2.23) | 1.73 (0.07) | 1.59 (0.08) | 203.80 (6.36) |

*Four Specimens per sample
**sample 16 is control not subjected to microcelluar process
N/A means "not applicable"; parenthetical values refer to the standard deviation The foamed parts prepared had an average weight reduction of 16 percent and a good surface and cell structure, with no blowouts. A reduction in hardness was achieved with all the microcellular foamed parts, with the best reductions in hardness being about 15 Shore A softer and 18 Shore D softer. The cell size ranged from 15 to 70 microns in the flow direction and 20 to 100 microns in the transverse direction. The surface appearance of the microcellular materials, the hardness reductions, and the cell structure were all best with low mold and stock temperatures. Each of these microcellular materials can be formed into one or more layers of a golf ball, or blends of microcellular composition disclosed herein can be formed into one or more layers of a golf ball.

It is to be recognized and understood that the invention is not to be limited to the exact configuration as illustrated and described herein. For example, it should be apparent that a variety of suitable materials would be suitable for use in the composition or method of making the golf balls according to the Detailed Description of the Invention. Accordingly, all expedient modifications readily attainable by one of ordinary skill in the art from the disclosure set forth herein are deemed to be within the spirit and scope of the present claims.

What is claimed is:

1. A method of adjusting at least one material property or weight distribution of a golf ball comprising:

at least partially melting a polymeric material;

saturating the melted polymeric material with a gas at a first pressure sufficient to substantially uniformly distribute the gas through the melted polymeric material;

shaping the gas-saturated polymeric material at an elevated pressure to prevent substantial cell nucleation within the material;

sufficiently reducing the first pressure, in the absence of sonic vibration, and supersaturating the shaped polymer material with a gas so that the polymer material is modified to form a substantially uniformly nucleated shaped microcellular polymeric material having closed-cell, microcellular voids having a diameter of no greater than about 100 microns;

solidifying the microcellular polymer material sufficiently to inhibit formation of additional voids; and incorporating the microcellular polymeric material into a golf ball.

2. The method of claim 1, wherein the polymeric material is selected from the group consisting of thermoplastics, thermoplastic elastomers, rubbers, thermosets, and mixtures thereof.

3. The method of claim 1, further comprising combining the polymeric material with at least one additive before being exposed to the gas.

4. The method of claim 3, wherein the at least one additive comprises a stabilizer, crosslinking agent, pigment, brightener, lubricant, or density-adjusting filler.

5. The method of claim 1, wherein the gas comprises air, a noble gas, nitrogen or carbon dioxide.

6. The method of claim 1, wherein the gas flow rate is at least about 0.005 lbs./hr.

7. The method of claim 1, wherein the incorporating comprises:

forming the microcellular composition into a portion of a golf ball core; and disposing a dimpled outer cover over the core so as to form the golf ball.

8. The method of claim 7, wherein the forming comprises:

forming the microcellular composition into a golf ball center; and providing at least one mantle layer over the center.

9. The method of claim 7, wherein the forming comprises at least one of injection molding, compression molding, reaction injection molding, or casting the microcellular composition.

10. The method of claim 1, wherein the golf ball is a one-piece golf ball.

11. The method of claim 1, wherein the step of incorporating the microcellular polymeric material into a golf ball comprises the steps of:

forming the microcellular composition into half shells; and compression molding the half shells over a core forming a dimpled outer cover.

12. The method of claim 1, wherein the step of incorporating the microcellular polymeric material into a golf ball comprises the steps of:

forming the microcellular composition into half shells; and compression molding the half shells over a core forming an inner cover layer.

13. The method of claim 1, wherein the step of incorporating the microcellular polymeric material into a golf ball comprises the steps of:

providing a golf ball center; and forming the microcellular composition into a layer disposed about the golf ball center.

14. The method of claim 13, wherein the step of forming the microcellular composition into a layer comprises the step of:

forming a cover layer disposed about the golf ball center.

15. The method of claim 14, wherein the step of forming a cover layer comprises the step of:

forming an inner cover layer disposed about the golf ball center; and forming an outer cover layer disposed about the inner cover layer.

16. The method of claim 14, wherein the step of forming a cover layer comprises the step of:

forming a dimpled outer cover disposed about the golf ball center.

* * * * *